US006118236A

United States Patent [19]

Shaw et al.

[11] Patent Number: 6,118,236

[45] Date of Patent: Sep. 12, 2000

[54] HAND-HELD, FINGER OR MOUTH-ACTUATED PNEUMATIC UNIT FOR REMOTE PROPORTIONAL CONTROL OF SEWING MACHINE

[75] Inventors: Bon F. Shaw; Juliann P. Shaw, both of Independence, Mo.

[73] Assignee: Bed Handles, Inc., Independence, Mo.

[21] Appl. No.: 09/432,585

[22] Filed: Nov. 12, 1999

Related U.S. Application Data

[60] Provisional application No. 60/118,577, Feb. 5, 1999.

[51] Int. Cl.[7] ..... D05B 23/00

[52] U.S. Cl. ..... 318/136; 318/446; 318/481; 318/544; 112/271; 112/276

[58] Field of Search ..... 318/671, 136, 318/446, 481, 488, 543, 544, 549, 551, 558; 388/929; 112/270, 271, 276

[56] References Cited

U.S. PATENT DOCUMENTS

| | | | |
|---|---|---|---|
| 3,946,174 | 3/1976 | Herbst | 73/410 |
| 4,583,474 | 4/1986 | Tysinger | 112/217.3 |
| 4,865,610 | 9/1989 | Muller | 623/24 |
| 4,970,978 | 11/1990 | Albertsson | 112/277 |
| 5,375,063 | 12/1994 | Peck et al. | 364/470 |

*Primary Examiner*—Bentsu Ro
*Attorney, Agent, or Firm*—Hovey, Williams, Timmons & Colloins

[57] ABSTRACT

A mouth and/or hand-held finger-actuated remote control unit is disclosed which is operable to permit selective variation of a pneumatic-operated controller (38, 42) having a proportional electrical control output to the electric motor (46) of a sewing machine (48). The unit comprises a hollow, elastic compressible bladder element (10, 110, 210) closed at one end and which is pneumatically connected to the controller. The bladder element is of length, width and height dimensions selected and proportioned to permit insertion of the bladder element in a person's mouth between the upper and lower teeth, or between the last fingers of a person's hand between the innermost knuckles and the person's palm. The bladder element is compressible by closing of a person's teeth thereon or movement of the fingers engaging the bladder toward the individual's palm to force air to the controller, thus controlling operation of the sewing machine. By modulating the pressure applied to bladder element 10 between the person's teeth or the last fingers and the person's palm, the machine may be turned off and on, and the speed of the sewing unit of machine may be controlled within very close limits, and can easily be varied from slow startup to full speed by simply applying more and more bite or finger pressure to the bladder element.

16 Claims, 1 Drawing Sheet

HAND-HELD, FINGER OR MOUTH-ACTUATED PNEUMATIC UNIT FOR REMOTE PROPORTIONAL CONTROL OF SEWING MACHINE

CROSS-REFERENCE TO RELATED APPLICATION

This application is a utility application based on U.S. provisional application, Ser. No. 60/118,577 filed Feb. 5, 1999, entitled AIR BLADDER MECHANISM FOR PROPORTIONAL CONTROL OF MACHINERY.

BACKGROUND OF THE INVENTION

1. Field of the Invention

This invention relates to hand-held, finger or mouth-actuated unit for permitting finger or mouth operation of a sewing machine by a person having a disability of the lower extremities. In particular, the invention relates to pneumatic control unit adapted to be connected to a controller for the electric motor of a sewing machine having a pneumatic input and an electrical output to the motor which is proportional to the pneumatic input.

Specifically, the invention concerns a small fluid bladder element having a nipple for receiving a fluid-conveying tube which is connected to the fluid inlet port of a conventional pneumatic/electrical controller operably coupled to the motor of a sewing machine. The bladder element is of a shape, size and material permitting a person having a disability of the lower extremities to control the speed of the motor of a sewing machine. Control may be accomplished by inserting the bladder element in their mouth and using the degree of closure of their teeth to control the extent of compression of the bladder element and thereby the pressure of the fluid on the input side of the sewing machine motor controller, which in turn regulates the speed of the motor.

The bladder element may also be used by the person by inserting the element between one or more of the last fingers of the user's hand and their palm, permitting selective finger compression of the bladder element, while at the same time leaving at least the thumb and first finger free to assist in guiding of material to the needle station of the machine.

2. Description of the Prior Art

Traditionally, sewing machines have been provided with an AC/DC induction motor for controlling the operation of the reciprocating needle and oscillation of the bobbin, as well as the coordinated movement of the material advancement unit. The controller operably connected to the sewing machine motor typically is of the combination pneumatic and electrical type, wherein pneumatic input to the controller results in a proportional electrical output to the motor. Increases in the pneumatic pressure to the controller thereby cause proportional increases of the speed of the motor and thereby corresponding increases in the speed of needle reciprocation, bobbin oscillation and material advancement.

Traditionally, the pneumatic/electrical controller for the induction motor of the sewing machine has been a foot control, knee paddles or a finger control on the housing of the sewing machine itself. The sewing machine motor pneumatic/electrical controller most usually has a closed bladder which is compressed or a diaphragm which is shifted by the foot control or the finger control on the machine housing. Compression of the bladder or movement of the diaphragm produces a pneumatic input from the controller and causes movement of a linear potentiometer, or a solid state pressure transducer to proportionally vary the speed of the induction motor.

However, if the user of the sewing machine has a disability of the lower extremities which prevents or limits the ability of that person to press a foot speed control, then the only option available was for that person to buy a machine with finger speed controls located on the sewing machine body. This meant though that the person necessarily lost the ability to use both hands in guiding the material through the advancement unit below the presser foot, significantly interfering with control of the fabric being sewn.

The foot speed controls that have been available are inherently too large to be held in a person's hand for operation of the motor of the sewing machine. Even if that was attempted, the individual still would not have both hands available for guiding the material beneath the presser foot.

Therefore, there has been a significant need for remote control unit that allows a person with a disability of the lower extremities to functionally control the operation of a sewing machine while leaving the essential fingers of both hands free to guide the material through the machine.

SUMMARY OF THE INVENTION

This invention concerns a hand-held, finger or mouth-actuated remote control unit for use by a person having a disability of the lower extremities to permit selective variation of a pneumatic-operated sewing machine controller having a proportional electrical output to the induction motor of the sewing machine. As a consequence, an individual with a lower extremity impediment, may maintain both-hands control over the advancement of material through a sewing machine head.

In particular, the invention relates to a remote control unit for sewing machines wherein is provided an elongated, hollow, elastic, compressible bladder element which is closed except for a fluid outlet orifice that is connected to a fluid conveying tube adapted to be joined to the pneumatic input of a pneumatic/electrical type controller for the induction motor of the sewing machine. The bladder element is suitably sized, shaped and constructed of material such that the user may place the bladder element in their mouth between the upper and lower teeth. The degree of compression of the bladder element by the user's teeth bite results in selective control of the speed of the sewing machine motor through the pneumatic/electrical controller, without any modification of that controller being required.

The bladder element may desirably take various forms, including an elongated, generally cylindrical bladder which may be placed in the user's mouth between the upper and lower teeth on one side of the mouth, or an essentially U-shaped bladder adapted to be inserted in the mouth for bite control with the teeth on both sides of the mouth. Alternatively, the bladder element may be a somewhat shorter bladder adapted to be inserted in the user's mouth in a central location, with a barrier disc being provided on the bladder in order to allow the user to control compression of the bladder with variable suction effort while the barrier disc prevents the bladder from being pulled into the user's mouth.

The bladder element in one form of the invention is of generally elongated, cylindrical configuration and of a size such that it may be either placed in the user's mouth for bite control, or placed between the user's last finger or fingers and palm whereby finger pressure controls the degree of compression of the bladder element and thereby the pressure applied to the pneumatic input port of the induction motor controller. Holding of the bladder element between one or more of the user's last fingers and palm leaves at least the thumb and first finger of that hand free to assist the other hand in guiding material to the advancement and needle unit of the sewing machine.

DESCRIPTION OF THE PREFERRED EMBODIMENTS

Figure 2:
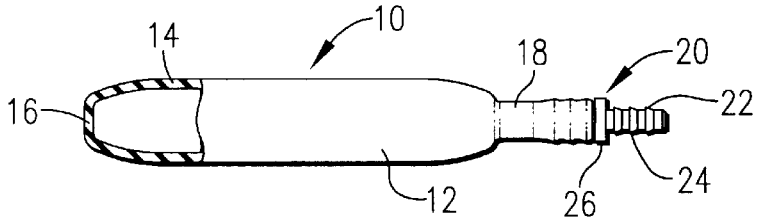
FIG. 2 is a side elevational view of a preferred generally cylindrical bladder element of the invention, with part of the bladder being broken away to review details of construction thereof.

Referring initially to FIG. 2 of the drawings, a hollow, elastic, compressible bladder element broadly designated 10 of preferred construction and configuration is constructed of medical-grade silicone rubber. Main body 12 of bladder element 10 has a generally cylindrical side wall 14 closed at one end by end wall 16 and an integral tubular nipple section 18 opposite end wall 16. A fitting 20 releasably connected to bladder element 10 includes an elongated, tubular, normally outermost section 22 provided with a series of circumferentially extending, longitudinally spaced serrations 24 defining barbed edges facing toward the central disc-shaped segment 26 of the fitting 20. Although not specifically shown, it is to be understood that fitting 20 has a section telescoped into nipple 18 and also provided with barb-defining serrations which serve to retain the barbed segment within the nipple 18.

The bladder element 10 preferably is constructed of silicone rubber, or in the alternative latex rubber, such that the cross-sectional thickness of side wall 14 and of end wall 16 is about 0.05 in.+0.05 in./−0 in. Furthermore, in its preferred form, main body 12 of element 10 is 2.25 in.+0.25 in./−0 in. in length, the diameter of main body 12 is about 0.45 in., and nipple section 18 is about 0.5 in.+0.1 in./−0 in. in length. The passage in nipple section 18 is about 0.1 in.+0.025 in./−0.01 in.

Figure 1:
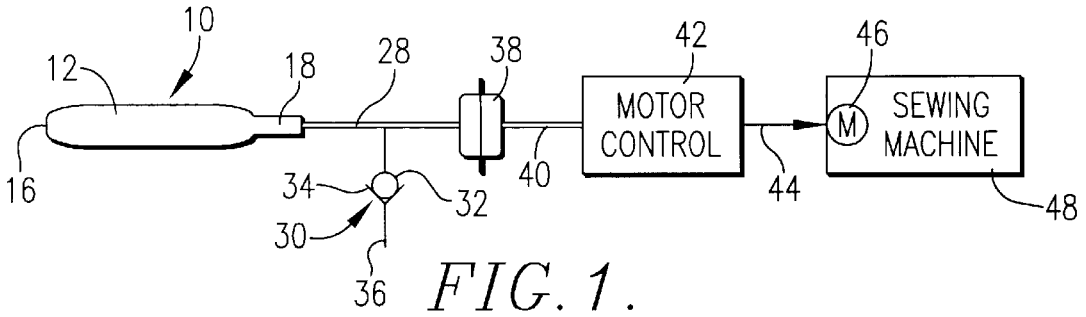
FIG. 1 is a schematic representation of one form of a bladder element constructed in accordance with preferred concepts of the present invention and illustrating the normal association of such element with a air inlet control valve, a pneumatic/electrical controller, a proportional motor control such as a linear potentiometer or solid state pressure transducer, and a sewing machine typically having an AC/DC induction motor.

Viewing FIG. 1, the serrated section 22 of fitting 20 is telescoped into a length of latex tubing 28. A one-way pneumatic check valve 30 is teed to and communicates with tubing 28 in proximal relationship to the nipple section 18 of main body 12. As is apparent from the schematic representation of FIG. 1, check valve 30 has a ball valve member 32 which normally engages valve seat 34. Valve 30 allows ambient makeup air to enter tubing 28 through the inlet 36 of the check valve 30 as required in the event leakage occurs in the pneumatic circuit. Ball 32 engages seat 34 to prevent exit of air from tubing 28 when pressure is exerted on the side wall 12 of bladder element 10.

A pneumatic/electrical controller 38 has a pneumatic inlet port which receives one end of the flexible tubing 28. An electrical output conduit 40 extends from the controller 38 to the input of motor control 42 which may, for example, be a linear potentiometer. The electrical output from the potentiometer extends via conduit 44 to the AC/DC induction motor 46 of sewing machine 48.

In use, a person having a disability of the lower extremities who desires to operate sewing machine 48 places bladder element 10 in their mouth with the side wall 12 positioned between the individual's upper and lower teeth on one side of their mouth. After machine 48 has been turned on, compression of the side wall 14 of bladder element 10 by closing of the persons's teeth, causes air trapped in main body 12 to be forced out of the main body 10 in proportion to the degree of compression and thereby directed along tubing 28 to the pneumatic/electrical controller 38. As a result, the pressurized air compresses the bladder or shifts the diaphragm of controller 38 thereby sending current to the linear potentiometer of motor control 42 which in turn directs current to motor 46 to operate the needle, bobbin, and material advancement unit of machine 48.

It is to be noted that when the person compresses bladder element 10 between their teeth, the air trapped in bladder element 10 and which is expelled from the interior thereof via nipple section 18, air is not permitted to escape via tubing 28 by virtue of closing of the check valve 30. The pneumatic pressure applied to controller 38 either compresses the bladder therein or shifts the diaphragm of the same to cause a electric current of proportional value to be sent to the linear potentiometer of motor control 42. This in turn directs electrical current of magnitude to induction motor 46 to operate the sewing unit of machine 48 at a speed that is commensurate with and proportional to the degree of compression of main body 12 of bladder element 10 between the person's teeth. The check valve 30 functions to allow a required amount of make-up air to enter tubing 28 and thereby the interior of bladder element 18, in the event there is a loss of air from the bladder element 10.

It is to be appreciated that by modulating the pressure applied to bladder element 10 between the person's teeth, the speed of the sewing unit of machine 48 may be controlled within very close limits, and can easily be varied from slow startup to full speed by simply applying more and more bite pressure to the bladder element 10. Similarly, the sewing machine may be stopped very quickly by simply letting up on the bite pressure on bladder element 10. Thus, the bladder element 10 pneumatically coupled to the controller 38 facilitates operation of sewing machine 48 in either a proportional, momentary or on/off method control.

When the bladder element 10 is hand-held, the main body 12 of the element is preferably located between a person's little finger and ring finger between the two innermost knuckles and the individual's palm. Alternatively, all three of the last fingers of a person's hand may be used to manipulate the bladder element 10 by compressing main body 12 between the inner knuckles of the individual's fingers and their palm. Positioning of the bladder element 10 between the last fingers of the individual's hand while leaving at least the fore finger and thumb free, these fingers may be used to assist with the person's other hand in guiding and manipulating fabric to be sewn as it is introduced into the needle station and guided by the fabric advancement unit below the presser foot.

Thus, by proper selection of the shape, size and material of construction of bladder element 10, a person with a disability of the lower extremities is provided with comfortable and practical speed control of sewing machine 48 by the simple expedient of placing bladder element 10 in the individual's mouth or strategic placement of the bladder element in the user's hand, thus obviating the need to operate the machine from a conventional foot control, or a switch on the housing of the sewing machine.

Figure 3:
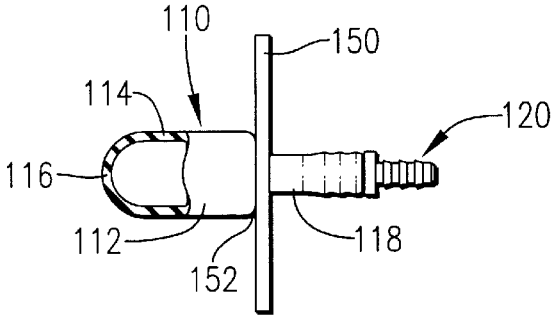
FIG. 3 is a side elevational view of another embodiment of the bladder element of this invention, again with part of the bladder being broken away.

In the alternate embodiment of the invention depicted in FIG. 3, the bladder element 110 has a main body 112 which is similar to body 12 of the embodiment of FIG. 2, except that body 112 is substantially shorter in length as is apparent from the drawing. Furthermore, bladder element 110 has a disc-shaped baffle 150 at the end 152 of main body 112 opposite end wall 116 thereof, which may be either circular or rectangular in configuration. The baffle 150 is positioned between end 152 of main body 112 and the nipple section 118 which is identical in construction to nipple 18 of bladder element 10. Likewise, the fitting 120 having an end telescoped into nipple section 118 is of the same construction as fitting 20 and serves the same purpose.

The intended function of bladder element 110 is identical to that of bladder element 10, except in this instance, the user places the main body 112 of bladder element 10 in the front of their mouth with the baffle 150 against and in engagement with the person's lips. Bladder element 110 is connected to a tube such as 28 which is in turn coupled to a pneumatic/electrical controller as previously described with respect to controller 28, and thereby to motor control 42 which is operably connected to the motor 46 of sewing machine 48. The material of construction, cross-sectional thickness of the side wall 114 and end wall 116, and the transverse dimension of the main body 112 of bladder element 110 is preferably the same as previously described with respect to bladder element 10.

Bladder element 110 is intended to be placed in front of the user's mouth between their front upper and lower teeth, rather than to one side of the mouth as is the case with bladder element 10. Compression of the main body 112 of bladder element 110 is accomplished by sucking on the bladder element with the degree of sucking pressure modulating the amount of air forced out of the bladder element 110 via the line connecting the bladder element to a pneumatic/electrical controller such as 38.

Figure 4:
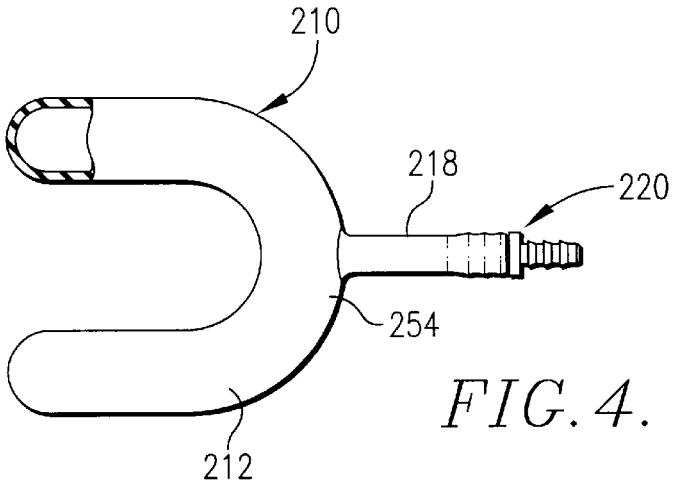
FIG. 4 is a plan view of a further embodiment of the bladder element of this invention, and also having a portion thereof broken away for clarity.

A third embodiment of the bladder element is depicted in FIG. 4 of the drawings and designated by the numeral 210. In this instance, the main body 212 of bladder element 210 is of generally U-shaped configuration, with a nipple section 218 being coupled to the bight section 254 of main body 212 and in direct communication with the hollow interior of main body 212. The wall thickness of main body 212, and the transverse dimension of each of the legs thereof are also desirably the same as the wall thickness and transverse dimension of the main body 12 of the bladder element 10.

Bladder element 210 is sized such that the entire element may be inserted in the user's mouth between all of their teeth. Thus, the maximum distance across the width of body 212 of bladder element 210 is selected such that the entire bladder element 210 may be comfortably inserted in the person's mouth. The bladder element 210 is provided with a fitting 220 the same as fittings 20 and 120, and also having a tubular section telescoped into the outer end of nipple section 218.

Control of sewing machine 48 is accomplished in the same manner as previously described in regard to use of bladder element 10, except that balanced bite pressure may be exerted on the U-shaped main body 212 by use of teeth on both sides of the person's mouth. This U-construction of the bladder element 210 prevents one side of the person's mouth from being fatigued to a greater extent than the other side of the mouth. Compression of the main body 212 within the person's mouth serves to force air from the interior of main body 212 via a line such as 28 to an pneumatic/electrical controller.

By proper selection of the shape, size and material of construction of bladder elements 10, 110 or 210, a person with a lower extremity impediment is provided with comfortable and practical speed control of sewing machine 48 by the simple expedient of placing bladder elements 10, 110 or 210 in the individual's mouth or strategic placement of the bladder element 10 in the user's hand, thus obviating the need to operate the machine from a conventional foot control, or a switch on the housing of the sewing machine.

We claim:

1. A mouth actuated remote control unit operable to permit selective variation of a pneumatic operated controller having a proportional electrical control output to the electric motor of a sewing machine and wherein the controller has a fluid input port, said remote control unit comprising:

a hollow, elastic, compressible bladder element for containing a quantity of controller actuating fluid and provided with a fluid outlet orifice;

a fluid transmitting conduit connected to said orifice of the element and adapted to be operably coupled to the port of said control unit for conveying fluid from the element to the controller, said element being of length, width and height dimensions permitting insertion thereof in a persons mouth between the upper and lower teeth with the height dimension being such that when the element in uncompressed condition is positioned between the person's teeth, that person's upper and lower teeth engaging the element are held apart a distance no greater than an amount that can be comfortably accommodated, said element being formed of non-toxic, flexible material defining a hollow bladder element which is closed except for the outlet orifice thereof, said element being compressible by closing of the person's teeth thereon to effect transfer of fluid from the element through the conduit to the inlet port of the controller; and a one-way fluid valve associated with said bladder element and the conduit which is operable to prevent loss of fluid from the element and from the conduit when the element is compressed by the person closing their teeth, resulting in transfer of fluid from the element to the port of the controller, and allowing fluid to enter the bladder element and the conduit when the person opens their teeth, thus causing the elastic element to return to its original shape.

2. A mouth-actuated control unit as set forth in claim 1 wherein said bladder element is of greater length than width or height.

3. A mouth-actuated control unit as set forth in claim 1, wherein said bladder element is of generally U-shaped configuration having separate leg portions integrally connected to a central bight section, the bight section being provided with said orifice therein, the distance between said leg portions being approximately equal to the span between a person's teeth permitting insertion of the element in the person's mouth for compression of the element by both sides of the person's teeth.

4. A mouth-actuated control unit as set forth in claim 1, wherein said element is of essentially domed-shaped configuration and is provided with a flexible panel thereon in surrounding relationship to the orifice in the element for limiting the degree to which the element may be inserted in the user's mouth.

5. A mouth-actuated control unit as set forth in claim 1, wherein said element is formed of surgical grade silicone.

6. A mouth-actuated control unit as set forth in claim 1, wherein the height dimension of the element is no more than about ¾ inch.

7. A mouth-actuated control unit as set forth in claim 1, wherein the height dimension of the element is no more than about ½ inch.

8. A mouth-actuated control unit as set forth in claim 1, wherein the length dimension of the element is no more than about 2½ inches.

9. A mouth-actuated control unit as set forth in claim 1, wherein the wall thickness of the element is no more than about 0.1 inch.

10. A mouth-actuated control unit as set forth in claim 1, wherein said element is of elongated, generally cylindrical configuration.

11. Hand-held, finger-actuated remote control unit operable to permit selective variation of a pneumatic operated controller having a proportional electrical control output to the electric motor of a sewing machine and wherein the controller has a fluid input port, said remote control unit comprising:

a hollow, elastic, compressible bladder element for containing a quantity of controller actuating fluid and provided with a fluid outlet orifice;

a fluid transmitting conduit connected to said orifice of the element and adapted to be operably coupled to the port of said control unit for conveying fluid from the element to the controller, said element being of length, width and height dimensions permitting insertion thereof between a person's last finger and palm for finger control of the degree of compression of the bladder element while leaving at least the thumb and forefinger free, said element being formed of non-toxic, flexible material defining a hollow bladder element which is closed except for the outlet orifice thereof, said element being compressible by movement of the person's finger toward their palm to effect transfer of fluid from the element through the conduit to the inlet port of the controller; and a one-way fluid valve associated with said bladder element and the conduit which is operable to prevent loss of fluid from the element and from the conduit when the element is compressed by the person's finger, resulting in transfer of fluid from the element to the port of the controller, and allowing fluid to enter the bladder element and the conduit when the person opens their finger, thus causing the elastic element to return to its original shape.

12. A hand-held, finger-actuated control unit as set forth in claim 11, wherein said element is of elongated, generally cylindrical configuration.

13. A hand-held, finger-actuated control unit as set forth in claim 11, wherein the height dimension of the element is no more than about ¾ inch.

14. A hand-held, finger-actuated control unit as set forth in claim 11, wherein the height dimension of the element is no more than about ½ inch.

15. A hand-held, finger-actuated control unit as set forth in claim 11, wherein the length dimension of the element is no more than about 2½ inches.

16. A hand-held, finger-actuated control unit as set forth in claim 11, wherein the wall thickness of the element is no more than about 0.1 inch.

* * * * *